US011002214B1

(12) United States Patent
Sarwar et al.

(10) Patent No.: US 11,002,214 B1
(45) Date of Patent: May 11, 2021

(54) EARLY DETECTION OF FUEL INJECTORS WITH MANUFACTURING ISSUES

(71) Applicant: GM GLOBAL TECHNOLOGY OPERATIONS LLC, Detroit, MI (US)

(72) Inventors: Azeem Sarwar, Rochester Hills, MI (US); Xiangxing Lu, San Jose, CA (US); Ibrahim Haskara, Macomb, MI (US); Yue-Yun Wang, Troy, MI (US); Chaitanya Sankavaram, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/656,949

(22) Filed: Oct. 18, 2019

(51) Int. Cl.
*F02D 41/38* (2006.01)
*F02M 63/02* (2006.01)
*F02D 41/22* (2006.01)

(52) U.S. Cl.
CPC ..... *F02D 41/3845* (2013.01); *F02M 63/0225* (2013.01); *F02D 41/221* (2013.01); *F02D 2041/224* (2013.01); *F02D 2200/0602* (2013.01); *F02D 2250/31* (2013.01)

(58) Field of Classification Search
CPC ..... F02D 41/3845; F02D 41/221; F02D 2250/31; F02D 2041/224; F02D 2041/226; F02D 2200/0602; F02D 19/025; F02D 19/0623; F02M 63/0225
See application file for complete search history.

(56) References Cited

U.S. PATENT DOCUMENTS

| | | | | |
|---|---|---|---|---|
| 7,899,608 | B1 * | 3/2011 | Pederson | G01M 15/11 701/111 |
| 10,026,241 | B1 | 7/2018 | Sankavaram et al. | |
| 10,152,834 | B1 | 12/2018 | Sankavaram et al. | |
| 2002/0148441 | A1 * | 10/2002 | Tuken | F02D 41/2451 123/436 |
| 2018/0328306 | A1 * | 11/2018 | Pursifull | F02D 41/2467 |
| 2020/0116099 | A1 * | 4/2020 | Surnilla | F02D 41/0085 |

OTHER PUBLICATIONS

U.S. Appl. No. 16/367,827, filed Mar. 28, 2019, Wang et al.
U.S. Appl. No. 16/420,687, filed May 23, 2019, Duan et al.

* cited by examiner

*Primary Examiner* — George C Jin

(57) ABSTRACT

A diagnostic system for a fuel injector includes a plurality of sensors to sense vehicle data. A controller includes a fuel injector diagnostic module configured to receive the vehicle data during operation of the vehicle and to selectively identify at least one of a fuel injector with a stuck armature and a fuel injector with pintle fatigue.

17 Claims, 11 Drawing Sheets

EARLY DETECTION OF FUEL INJECTORS WITH MANUFACTURING ISSUES

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to internal combustion engines and more particularly to fuel injector control systems and methods for engines.

Air is drawn into an engine through an intake manifold. A throttle valve and/or engine valve timing controls airflow into the engine. The air mixes with fuel from one or more fuel injectors to form an air/fuel mixture. The air/fuel mixture is combusted within one or more cylinders of the engine. Combustion of the air/fuel mixture may be initiated by, for example, spark provided by a spark plug.

Combustion of the air/fuel mixture produces torque and exhaust gas. Torque is generated via heat release and expansion during combustion of the air/fuel mixture. The engine transfers torque to a transmission via a crankshaft, and the transmission transfers torque to one or more wheels via a driveline. The exhaust gas is expelled from the cylinders to an exhaust system.

Improper operation of the fuel injectors can lead to one or more problems. For example, improper operation of the fuel injectors can lead to a rough idle or engine misfires. If the faulty fuel injector remains undiagnosed, the engine may develop additional problems.

SUMMARY

A diagnostic system for a fuel injector includes a plurality of sensors to sense vehicle data. A controller includes a fuel injector diagnostic module configured to receive the vehicle data during operation of the vehicle and to selectively identify at least one of a fuel injector with a stuck armature and a fuel injector with pintle fatigue.

In other features, the fuel injector diagnostic module is configured to identify the fuel injector with the stuck armature based on a short term fuel trim values. The fuel injector diagnostic module is configured to identify the fuel injector with the stuck armature in response to short term fuel trim values increasing and cylinder misfires occurring.

In other features, the fuel injector diagnostic module is configured to identify the fuel injector with the stuck armature during an engine cold start. The fuel injector diagnostic module is configured to identify the fuel injector with the stuck armature when an engine cold start short term fuel trim value is not nominal.

In other features, the fuel injector diagnostic module is configured to identify the fuel injector with the stuck armature when a fuel rail pressure is greater than a predetermine fuel rail pressure. The fuel injector diagnostic module is configured to identify the fuel injector with the pintle fatigue based on a fast Fourier transform (FFT) of cylinder misfires as a function of a plurality of groups of consecutive engine revolutions in a window. The fuel injector diagnostic module is configured to identify the fuel injector with the pintle fatigue in response to the FFT having an amplitude greater than a predetermined amplitude at a frequency greater than a predetermined frequency in the window.

In other features, the fuel injector diagnostic module is configured to identify the fuel injector with the pintle fatigue based on a fast Fourier transform (FFT) of cylinder misfires as a function of a plurality of groups of consecutive engine revolutions in a plurality of windows.

In other features, the fuel injector diagnostic module is configured to identify the fuel injector with the pintle fatigue in response to greater than or equal to X of Y consecutive ones of the plurality of windows having an amplitude greater than a predetermined amplitude at a frequency greater than a predetermined frequency, where X and Y are integers and X is less than Y.

In other features, the fuel injector diagnostic module is configured to identify the fuel injector with the stuck armature further in response to long term fuel trim values changing more than a predetermined amount during a period less than a predetermined period.

A diagnostic system for a fuel injector includes a plurality of sensors to sense vehicle data. A fuel injector diagnostic module is configured to receive the vehicle data during operation of the vehicle and selectively identify a fuel injector with pintle fatigue based on a fast Fourier transform (FFT) of cylinder misfires as a function of a plurality of groups of consecutive engine revolutions in a window.

In other features, the fuel injector diagnostic module is further configured to identify a fuel injector with a stuck armature based on a short term fuel trim values. The fuel injector diagnostic module is configured to identify the fuel injector with the stuck armature, during an engine cold start, in response to short term fuel trim values increasing and cylinder misfires occurring.

In other features, the fuel injector diagnostic module is configured to identify the fuel injector with the pintle fatigue in response to the FFT having an amplitude greater than a predetermined amplitude at a frequency greater than a predetermined frequency in a plurality of windows. The fuel injector diagnostic module is configured to identify the fuel injector with the pintle fatigue in response to greater than or equal to X of Y consecutive ones of the plurality of windows having the amplitude greater than the predetermined amplitude at the frequency greater than the predetermined frequency, where X and Y are integers and X is less than Y.

In other features, the fuel injector diagnostic module is configured to identify the fuel injector with the stuck armature further in response to long term fuel trim values changing more than a predetermined amount during a period less than a predetermined period.

A diagnostic system for fuel injectors of a plurality of vehicles a server located remotely from the plurality of vehicles and configured to receive vehicle data generated by the plurality of vehicles during operation. The server includes a fuel injector diagnostic module configured to receive the vehicle data from the plurality of vehicles and to selectively identify at least one of one of the plurality of vehicles having a fuel injector with a stuck armature and one of the plurality of vehicles having a fuel injector with pintle fatigue.

In other features, the fuel injector diagnostic module is configured to identify the fuel injector with the stuck armature in response to short term fuel trim values increasing during an engine cold start and cylinder misfires occurring during the engine cold start. The fuel injector diagnostic module is configured to identify the fuel injector with the pintle fatigue based on a fast Fourier transform (FFT) of cylinder misfires as a function of a plurality of groups of consecutive engine revolutions in a window.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts a mixture of air and fuel within cylinders to generate drive torque. A throttle valve regulates airflow into the engine. Fuel is injected by fuel injectors. Spark plugs may generate spark within the cylinders to initiate combustion. Spark plugs may be omitted in some types of engines, such as diesel engines. Intake and exhaust valves of a cylinder may be controlled to regulate flow into and out of the cylinder.

The fuel injectors receive fuel from a fuel rail. In some examples, a high pressure fuel pump receives fuel from a low pressure fuel pump and pressurizes the fuel within the fuel rail. The low pressure fuel pump draws fuel from a fuel tank and provides fuel to the high pressure fuel pump. The fuel injectors inject fuel directly into the cylinders of the engine. Power is applied to a fuel injector to open (e.g., a pintle or anchor of) the fuel injector.

One or more of the fuel injectors may have manufacturing issues. Examples of the manufacturing issues include pintle fatigue and/or a struck armature. Improper heat treatment of the pintle can cause the pintle to fatigue and fail earlier than expected. Decreased clearance of the armature may cause inconsistent movement of the armature. When these types of manufacturing issues are not detected early, the fuel injectors can cause additional damage, which increases warranty costs.

Systems and methods according to the present disclosure perform early identification of fuel injectors with manufacturing issues. More particularly, the systems and methods monitor control and diagnostic signals to identify fuel injectors with manufacturing issues to allow earlier repair before further damage occurs.

Figure 1A:
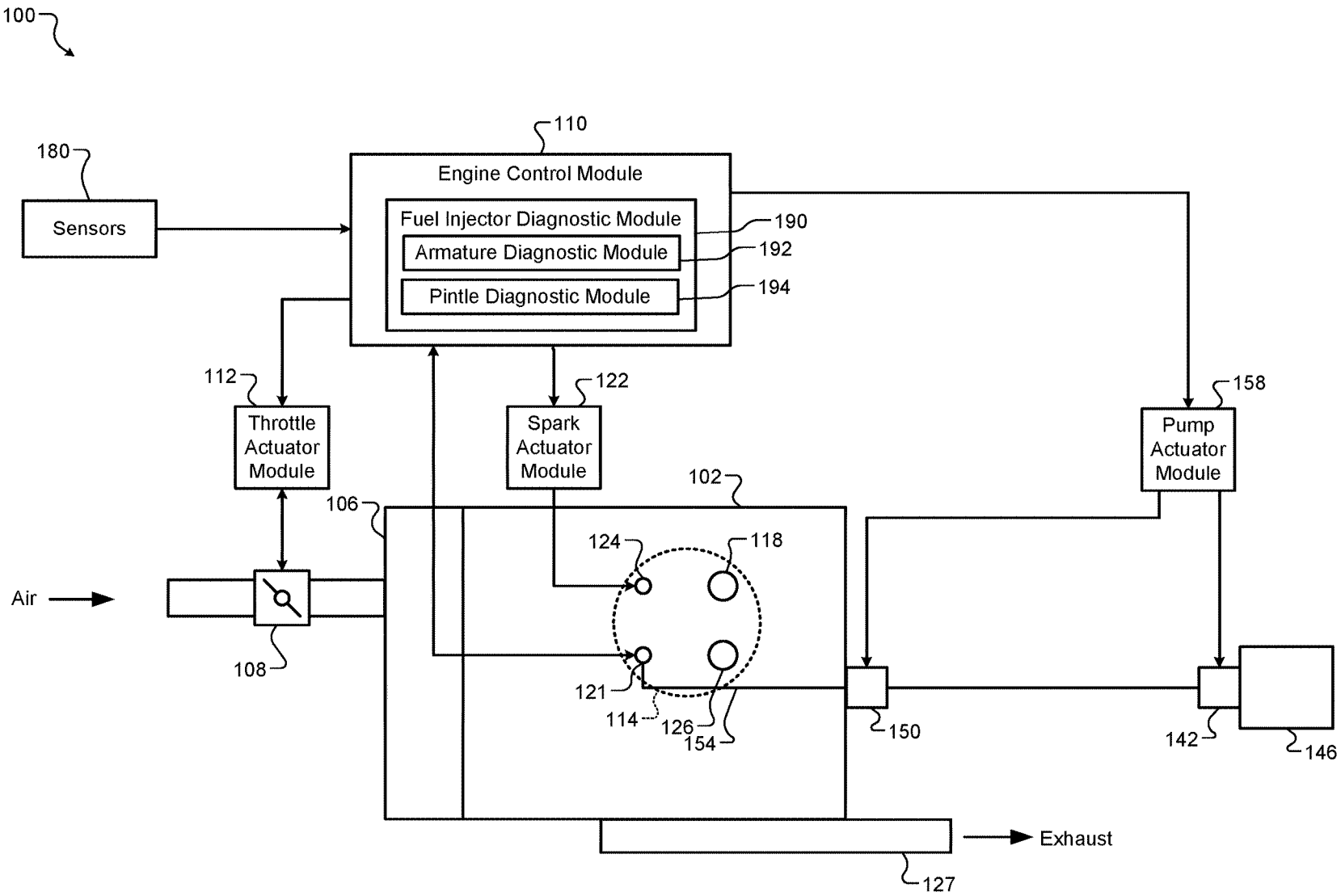
FIG. 1A is a functional block diagram of an example of an engine control system including according to the present disclosure.

Referring now to FIG. 1A, a functional block diagram of an example engine system 100 is presented. The engine system 100 includes an engine 102 that combusts an air/fuel mixture to produce drive torque for a vehicle. While the engine 102 will be discussed as a spark ignition direct injection (SIDI) engine, the engine 102 may include another type of direct injection engine. In some examples, one or more electric motors and/or motor generator units (MGUs) (not shown) may be provided in addition to the engine 102.

Air is drawn into an intake manifold 106 through a throttle valve 108. The throttle valve 108 may vary airflow into the intake manifold 106. For example only, the throttle valve 108 may include a butterfly valve having a rotatable blade. An engine control module (ECM) 110 controls a throttle actuator module 112 (e.g., an electronic throttle controller or ETC), and the throttle actuator module 112 controls opening of the throttle valve 108.

Air from the intake manifold 106 is drawn into cylinders of the engine 102. While the engine 102 may include more than one cylinder, only a single representative cylinder 114 is shown. Air from the intake manifold 106 is drawn into the cylinder 114 through an intake valve 118. One or more intake valves may be provided with each cylinder.

The ECM 110 controls fuel injection (e.g., amount and timing) into the cylinder 114 via a fuel injector 121. The fuel injector 121 injects fuel, such as gasoline or diesel fuel, directly into the cylinder 114. In some examples, the fuel injector 121 is a solenoid type, direct injection fuel injector. The ECM 110 may control fuel injection to achieve a desired air/fuel ratio, such as a stoichiometric air/fuel ratio. A fuel injector is provided for each cylinder.

The injected fuel mixes with air and creates an air/fuel mixture in the cylinder 114. Based upon a signal from the ECM 110, a spark actuator module 122 may energize a spark plug 124 in the cylinder 114. A spark plug may be provided for each cylinder. Spark generated by the spark plug 124 ignites the air/fuel mixture. Spark plugs may be omitted in some types of engines, such as diesel engines.

The engine 102 may operate using a four-stroke cycle or another suitable operating cycle. The four strokes, described below, may be referred to as the intake stroke, the compression stroke, the combustion stroke, and the exhaust stroke. During each revolution of a crankshaft (not shown), two of the four strokes occur within the cylinder 114. Therefore, two revolutions crankshaft are necessary for the cylinders to experience all four of the strokes.

During the intake stroke, air from the intake manifold 106 is drawn into the cylinder 114 through the intake valve 118. Fuel injected by the fuel injector 121 mixes with air and creates an air/fuel mixture in the cylinder 114. One or more fuel injections may be performed during a combustion cycle. During the compression stroke, a piston (not shown) within the cylinder 114 compresses the air/fuel mixture. During the combustion stroke, combustion of the air/fuel mixture drives the piston, thereby driving the crankshaft. During the exhaust stroke, the byproducts of combustion are expelled through an exhaust valve 126 to an exhaust system 127.

A low pressure fuel pump 142 draws fuel from a fuel tank 146 and provides fuel at low pressures to a high pressure fuel pump 150. While only the fuel tank 146 is shown, more than one fuel tank 146 may be implemented. The high pressure fuel pump 150 further pressurizes the fuel within a fuel rail 154. The fuel injectors of the engine 102, including the fuel injector 121, receive fuel via the fuel rail 154. Low pressures provided by the low pressure fuel pump 142 are described relative to high pressures provided by the high pressure fuel pump 150.

The low pressure fuel pump 142 may be an electrically driven pump. The high pressure fuel pump 150 may be a variable output pump that is mechanically driven by the engine 102. A pump actuator module 158 may control operation (e.g., output) of the high pressure fuel pump 150. The pump actuator module 158 controls the high pressure fuel pump 150 based on signals from the ECM 110. The pump actuator module 158 may also control operation (e.g., ON/OFF state) of the low pressure fuel pump 142.

The engine system 100 may include one or more sensors 180. For example, the sensors 180 may include one or more fuel pressure sensors, a mass air flowrate (MAF) sensor, a manifold absolute pressure (MAP) sensor, an intake air temperature (IAT) sensor, a coolant temperature sensor, an oil temperature sensor, a crankshaft position sensor, one or more wheel speed sensors, a fuel rail pressure sensor and/or one or more other suitable sensors.

The ECM 110 includes a fuel injector diagnostic module 190 that performs one or more diagnostics to identify manufacturing issues with one or more fuel injectors. The fuel injector diagnostic module 190 includes an armature diagnostic module 192 configured to diagnose manufacturing issues related to a stuck armature. The fuel injector diagnostic module 190 includes a pintle diagnostic module 194 configured to diagnose manufacturing issues related to pintle fatigue.

Figure 1B:
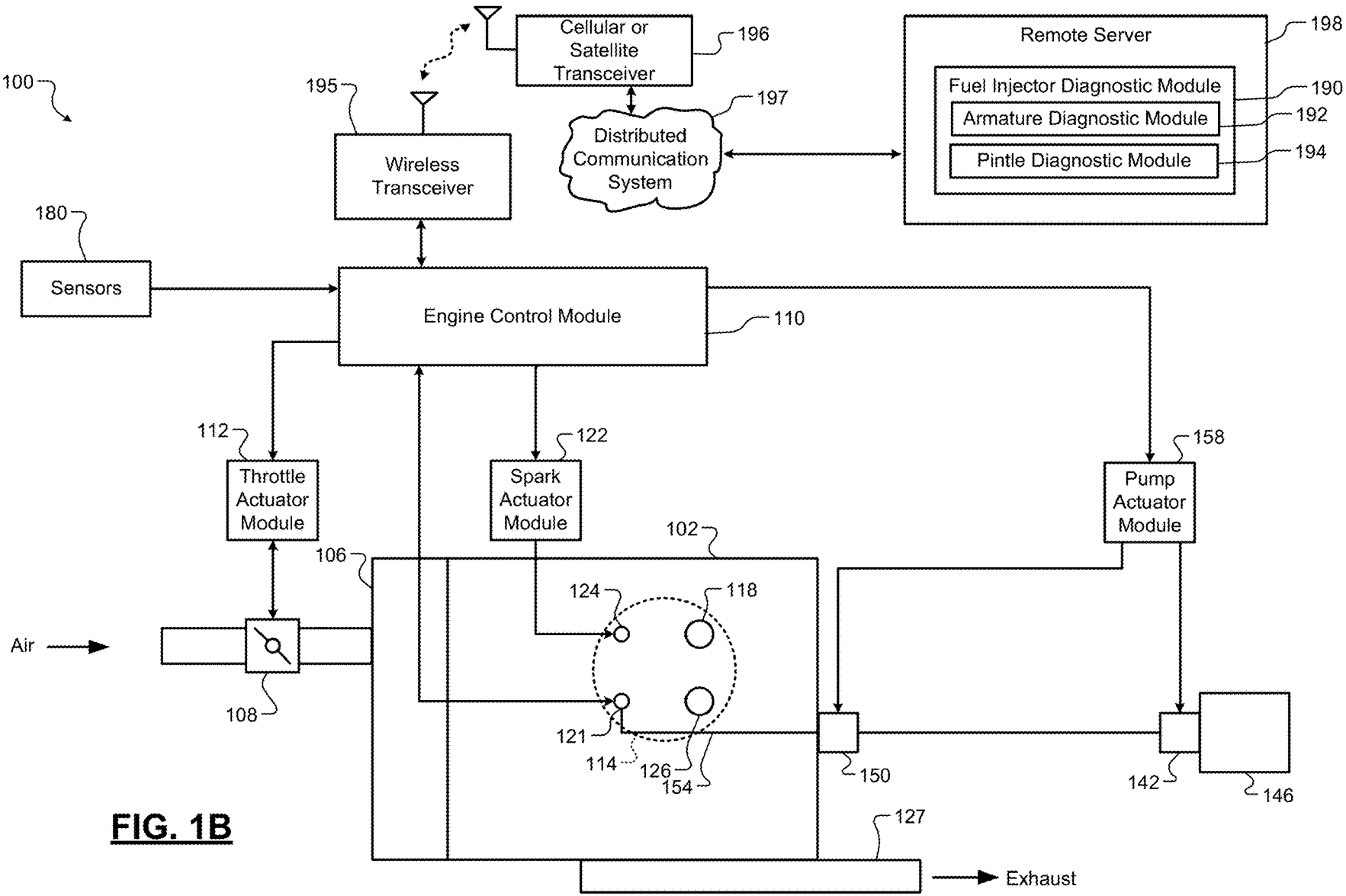
FIG. 1B is a functional block diagram of an example of an engine control system according to the present disclosure.

Referring now to FIG. 1B, rather than processing the captured data locally, the ECMs 110 of a plurality of vehicles can transmit the vehicle data for processing remotely. For example, the plurality of vehicles may include wireless transceivers 195 that transmit data to and receive data from cellular or satellite transceivers 196 that are directly or indirectly connected to a distributed communications system 197 such as the Internet. A remote server 198 is directly or indirectly connected to the distributed communications system 197 and includes the fuel injector diagnostic module 190 that performs one or more diagnostics to identify manufacturing issues with one or more fuel injectors of a plurality of vehicles based on vehicle data sent from the plurality of vehicles. The fuel injector diagnostic module 190 includes the armature diagnostic module 192 and/or the pintle diagnostic module 194 described above. If an injector problem is diagnosed, the remote server 198 generates and transmits a diagnostic message to corresponding ones of the plurality of vehicles that sent the vehicle data diagnosed with an injector problem. In some examples, the diagnostic message generates a visual or audible message to have the fuel injectors or vehicle serviced.

Figure 2B:
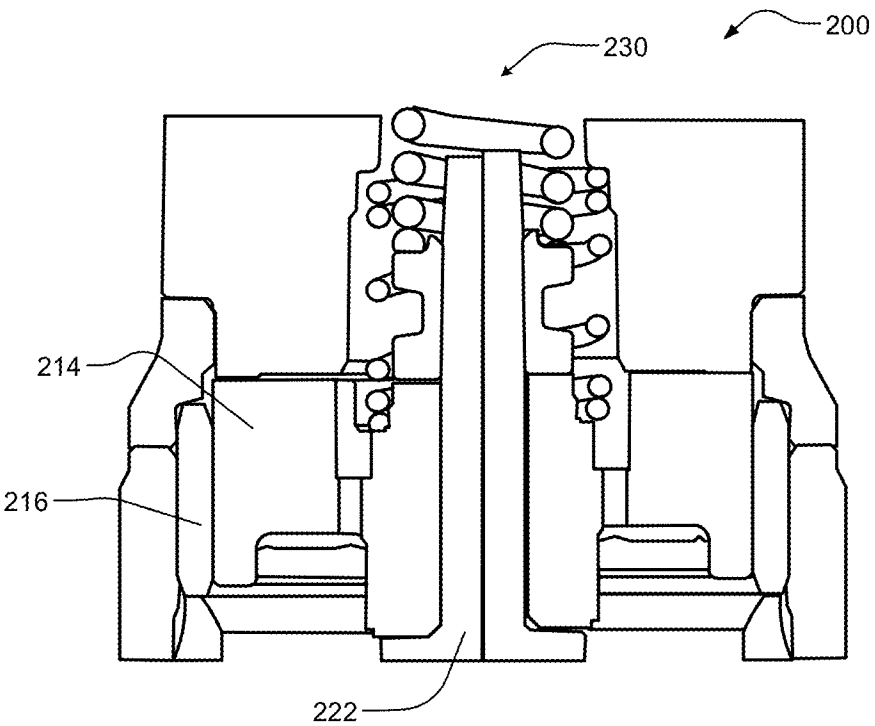
FIGS. 2A and 2B are side cross-sectional views of an example of a fuel injector according to the present disclosure.
Figure 2A:
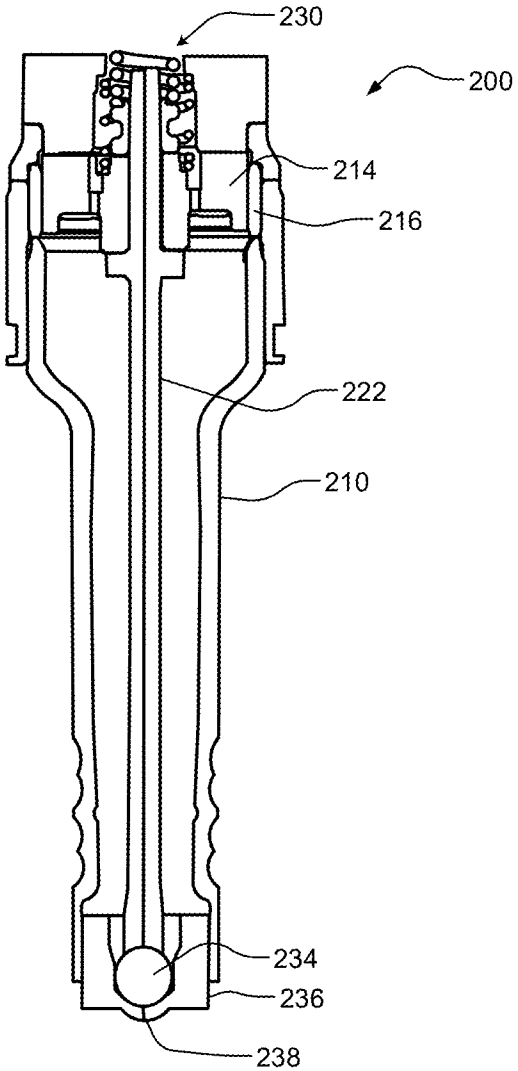

Referring now to FIGS. 2A and 2B, an example of a fuel injector 200 is shown. The fuel injector 200 includes a body 210 housing an armature 214 arranged radially inside of a guide sleeve 216. When energized, the armature 214 selectively moves a pintle 222 upwardly against one or more springs 230, which temporarily relieves pressure on a pintle ball 234 against an inner surface of a nozzle body 236 defining a nozzle 238. When pressure on the pintle ball is released, fuel passes through the nozzle 238. When de-energized, the armature 214 does not exert force against the springs 230 and the pintle 222 biases the pintle ball 234 against the inner surface of the nozzle body 236 blocking the nozzle 238.

One or more of the injectors may cause improper operation due to manufacturing issues. Examples of the manufacturing issues include pintle fatigue and/or a struck armature. For example, improper heat treatment of the pintle can cause the pintle to fatigue and fail earlier than expected. Decreased clearance of the armature may cause inconsistent movement of the armature. When these types of manufacturing issues are not detected early, the injectors can cause additional damage and increase warranty costs.

Figure 3:
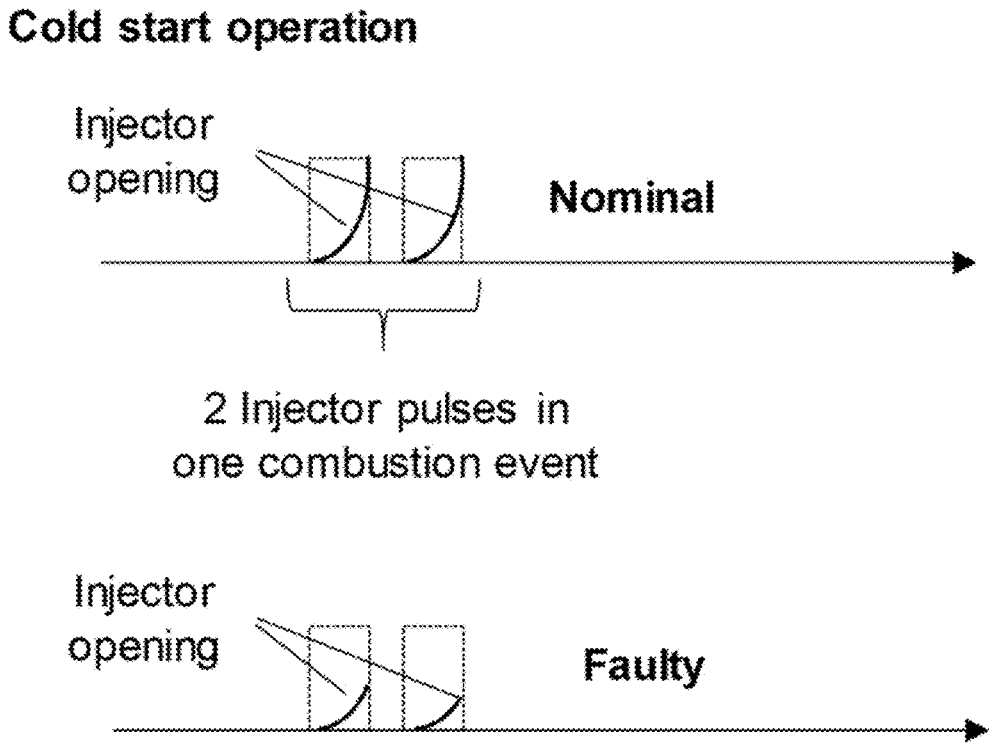
FIG. 3 is an example of a fuel injector timing diagram for a single combustion event according to the present disclosure.
Figure 4:
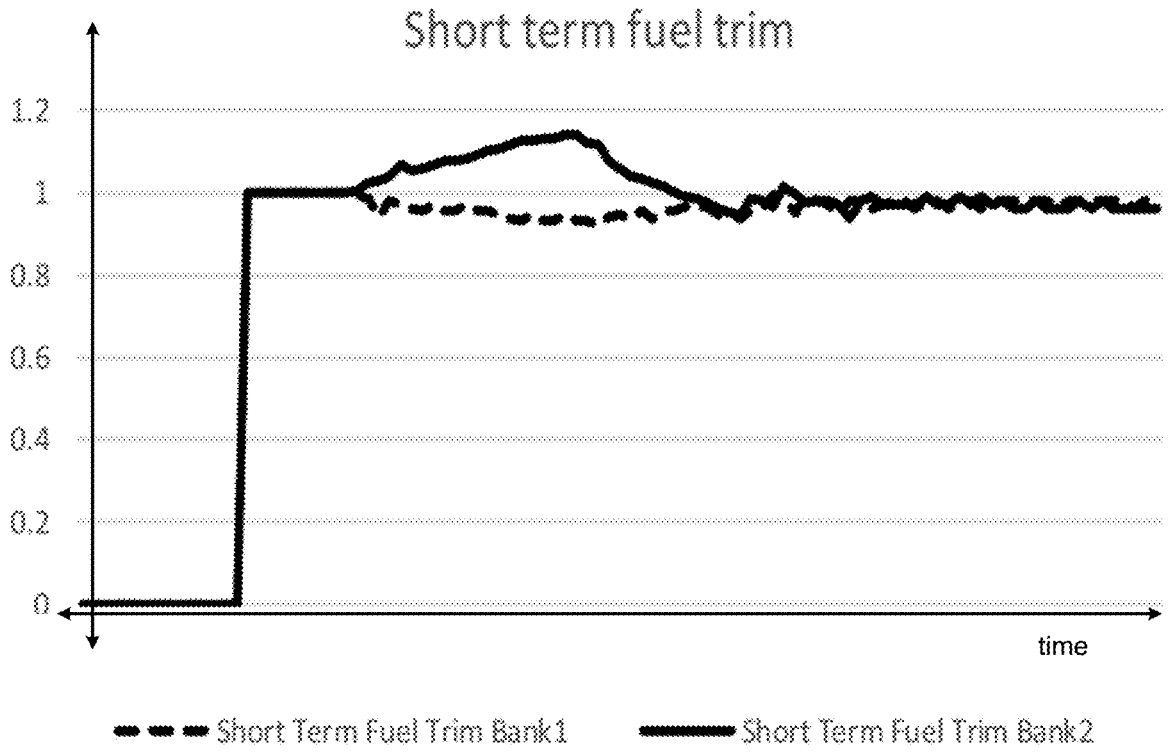
FIG. 4 is an example of short term fuel trim values as a function of time according to the present disclosure.
Figure 5:
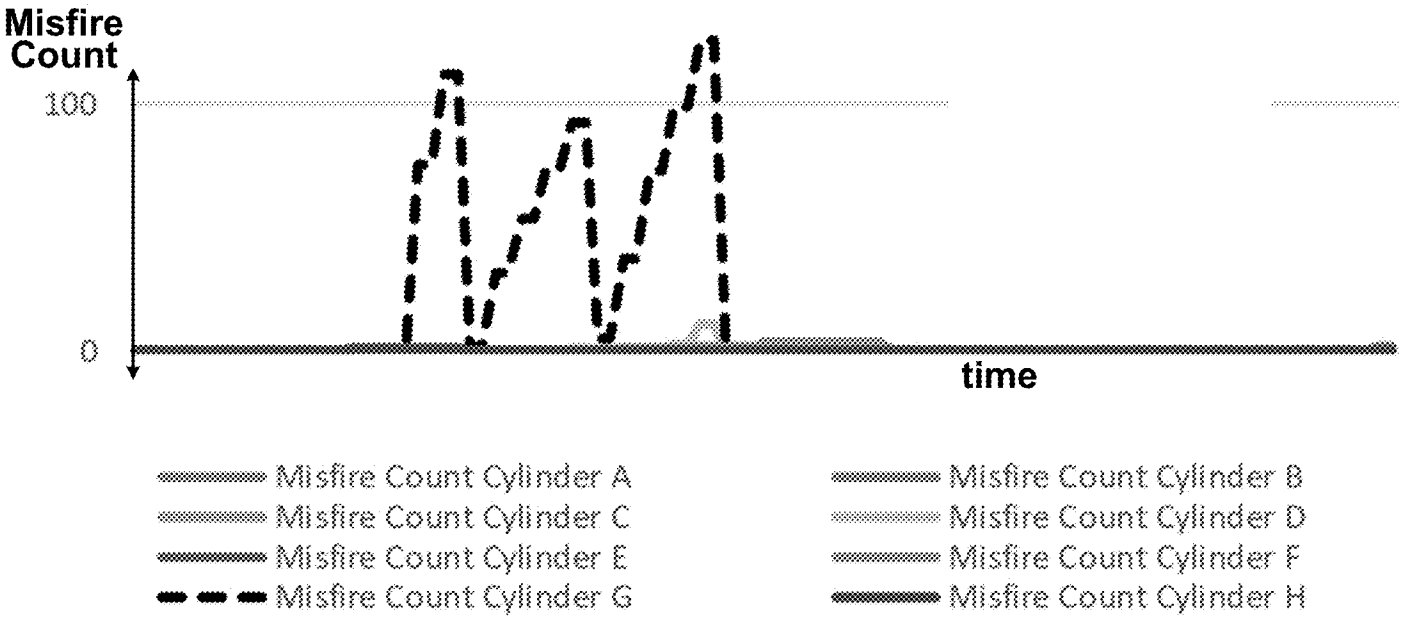
FIG. 5 is an example of misfire count values as a function of time according to the present disclosure.

Referring now to FIGS. 3, 4 and 5, faulty and nominal operation of the fuel injectors are shown. In FIG. 3, a fuel injector timing diagram for a single combustion event is shown. In FIG. 4, short term fuel trim to compensate for faulty operation is shown. In FIG. 5, misfire counts for each cylinder are shown. Systems and methods according to the present disclosure extract features from control and diagnostic signals to identify failure modes relating to manufacturing issues early.

During cold start operation, injector openings with nominal pulses are shown in an upper portion in FIG. 3 and injector openings with faulty pulses are shown in a lower portion in FIG. 3. As can be seen, decreased clearance between the armature and the guide sleeve requires larger force and consequently increases the response time of the injector. Less fuel is delivered and the idle becomes rough. This issue may be compensated by making the injector open for a longer period of time (short term fuel trim as shown in FIG. 4). When less fuel is delivered, this condition can also cause the cylinder to misfire (as shown in FIG. 5).

Figure 6:
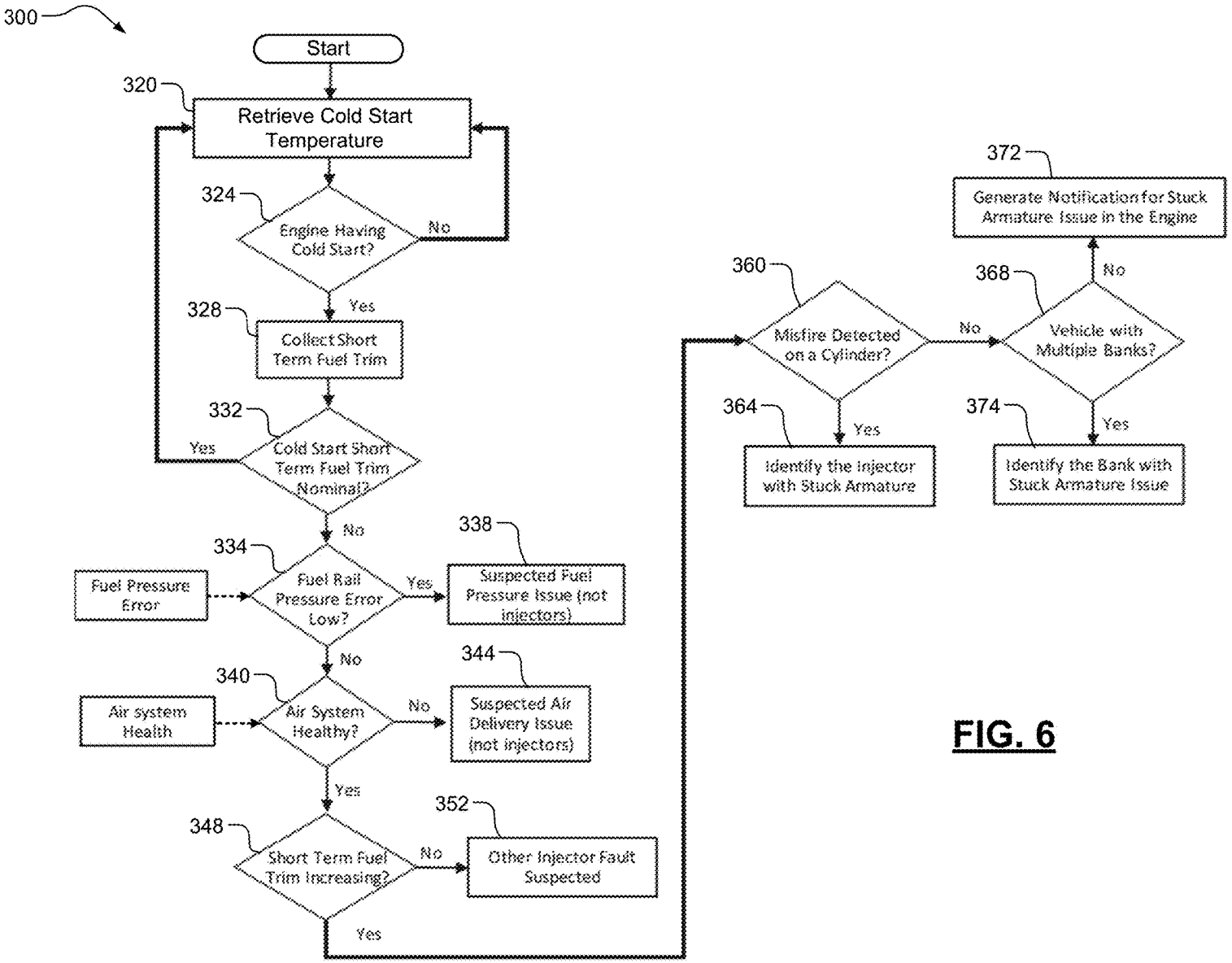
FIG. 6 is a flowchart of an example of a method for diagnosing a stuck armature in a fuel injector according to the present disclosure.

Referring now to FIG. 6, a method 300 for detecting fuel injectors with manufacturing issues is shown. At 320, a cold start threshold temperature is retrieved. At 324, the method determines whether the engine is having a cold start based on the cold start temperature and engine temperature. In some examples, coolant temperature is used as the engine temperature and compared to the cold start threshold temperature to determine whether or not the engine start is a cold start.

If 324 is false, the method returns to 320. If 324 is true, method continues at 328 and retrieves short-term fuel trim values. At 332, the method determines whether the cold start short-term fuel trim value is a nominal value. If 332 is true, the method returns to 320. If 332 is false, the method continues at 334 and determines whether the fuel rail pressure is in a low error condition. If 334 is true, the method continues at 338 and sets a diagnostic flag related to suspected fuel pressure issues (and does not set a diagnostic flag related to the fuel injectors).

If 334 is false, the method continues at 340 and determines whether an intake air system is healthy based on intake air system health parameters. An example of systems and methods for determining whether the air system is healthy can be found in commonly-assigned U.S. Pat. No. 10,026,241, entitled "COMBUSTION ENGINE AIRFLOW MANAGEMENT SYSTEMS AND METHODS" and U.S. Pat. No. 10,152,834 entitled "COMBUSTION ENGINE AIRFLOW MANAGEMENT SYSTEMS AND METHODS", which are hereby incorporated by reference in their entirety. If 340 is false and the intake air system is not healthy, the method diagnoses a suspected air delivery issue and sets a diagnostic flag (and not a fuel injector diagnostic flag).

If 340 is true and the intake air system is healthy, the method determines whether the short term fuel trim is increasing at 348. In some examples, the slope and/or magnitude of the short term fuel trim are compared to a predetermined slope and/or magnitude, respectively. For example, the short term fuel trim is considered to be increasing if the slope is greater than a predetermined slope (such as 0.4, 0.5, 0.6, 0.7 and/or another value) and/or if the magnitude of the short term fuel trim is greater than a predetermined magnitude (such as 110% or 120% of a nominal short term fuel trim value) (although other thresholds can be used). In some examples, if the slope and/or magnitude exceed the predetermined slope and/or magnitude, then the short term fuel trim is considered to be increasing.

If 348 is false (the short term fuel trim is decreasing or not sufficiently increasing), the method determines that another injector fault is suspected at 352. If 348 is true (the short term fuel trim is sufficiently increasing), the method continues at 360 and determines whether misfire is detected on a cylinder. In some examples, a single misfire is sufficient, although a higher number of misfires can be used. If 360 is true, the method continues at 364 and identifies the injector with a stuck armature. If 360 is false, the method continues at 368 and determines whether the engine has multiple cylinder banks. If 368 is true, the method generates a notification identifying the bank with the stuck armature at 374. If 368 is false, the method generates a notification that the engine has a stuck armature at 372.

Figure 7:
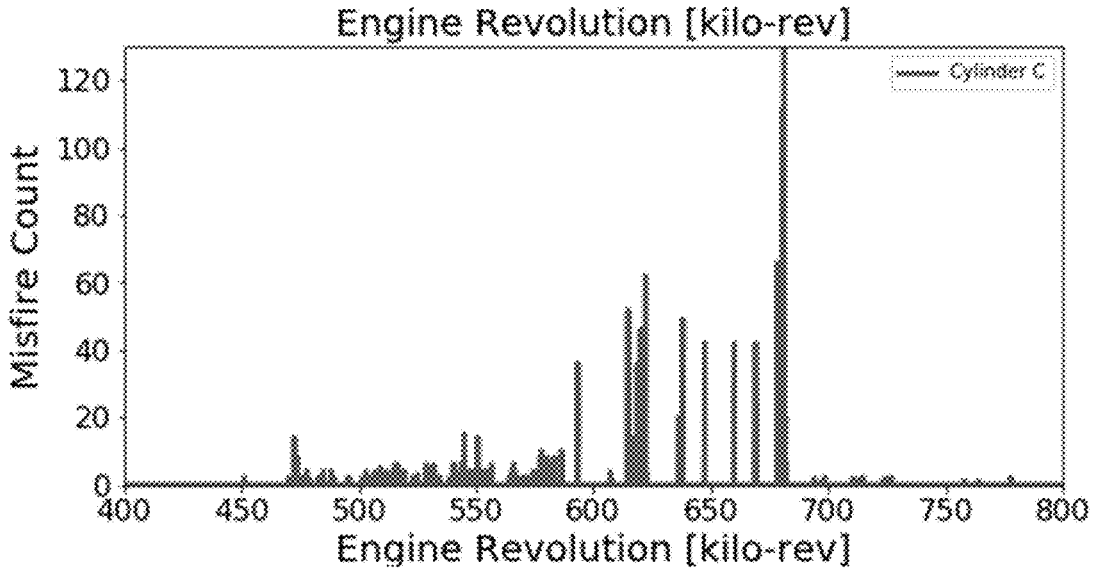
FIGS. 7 and 8 are examples of misfire count values as a function of engine revolutions according to the present disclosure.
Figure 8:
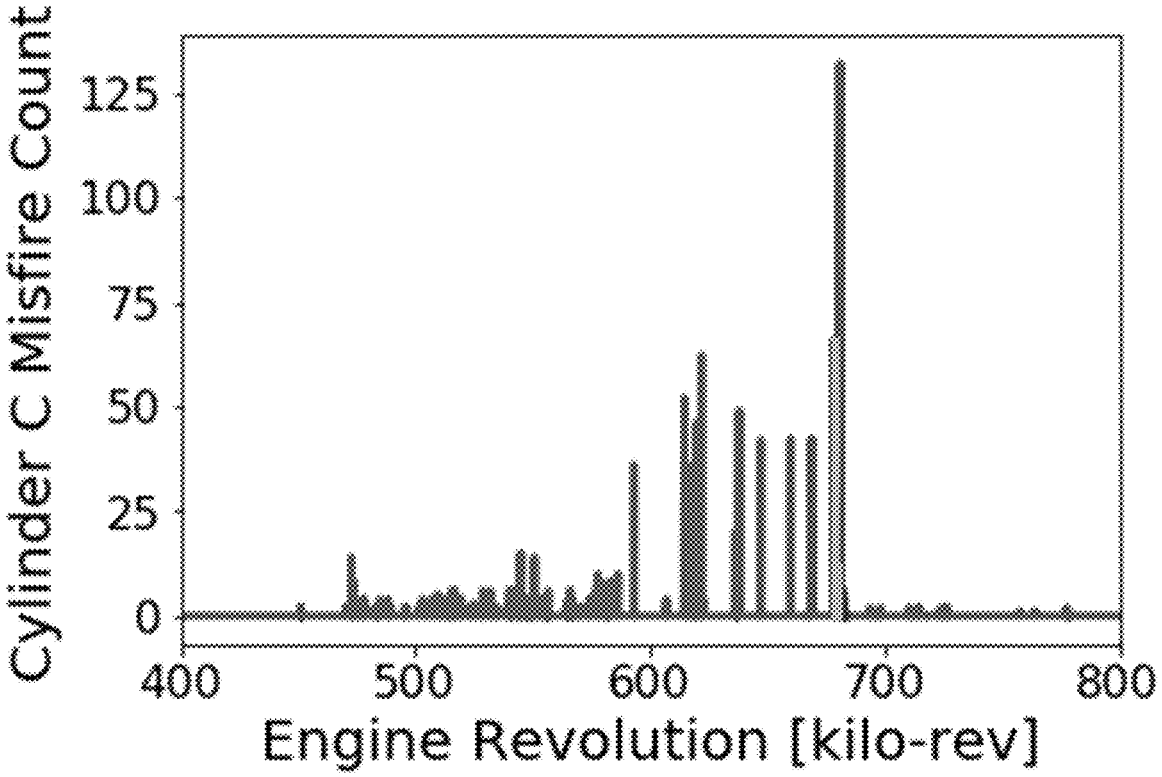

Referring now to FIGS. 7 to 10, cylinder specific misfire patterns are used to identify injector failure due to pintle fatigue. In FIGS. 7 and 8, misfires are collected as a function of total engine revolutions. In some examples, the misfire counts for successive engine revolutions are collected, grouped or binned. In some examples, misfire counts are collected for each bin or group including B engine revolutions, where B is an integer greater than 100. For example, B can be set to 100, 200, 500, 1000, 2000 or other numbers of engine revolutions.

A moving window fast Fourier transform (FFT) can be used to reveal the presence of higher frequency signals with large magnitudes. Each of the bins of engine revolutions are equivalent to a unit of time. The moving window includes M bins, where M is an integer greater than 1. In some examples, B=25, 50, 75 or 100, although higher or lower numbers can be used. The FFT is performed on the moving window. Then, the moving window is incremented by one bin and the FFT is repeated.

Figure 9:
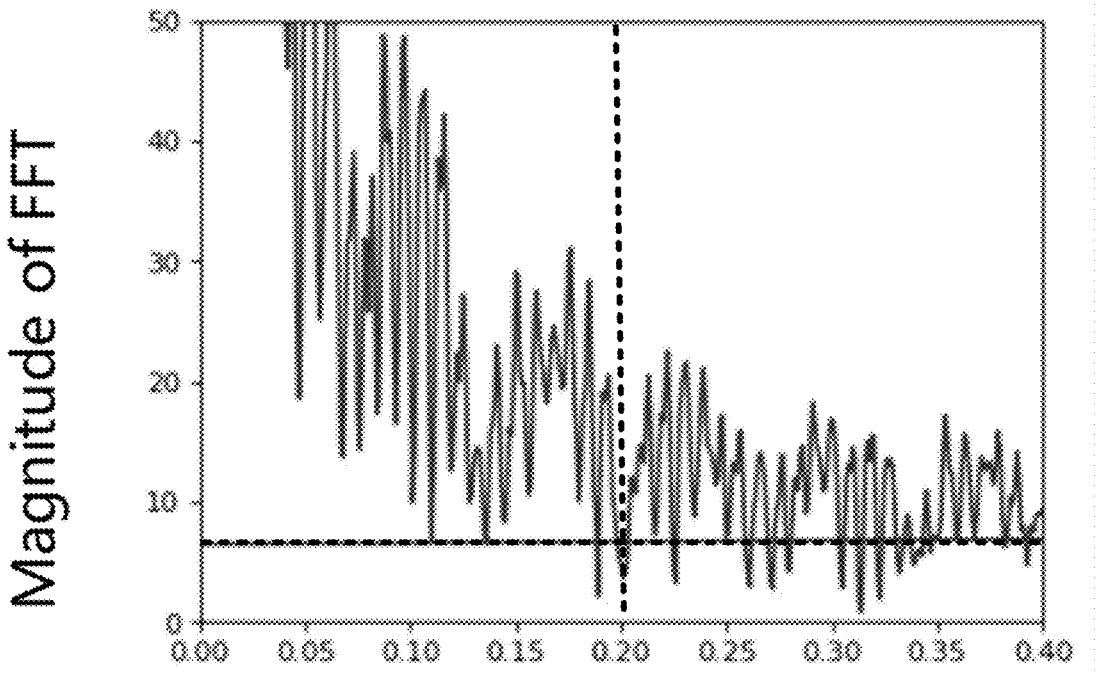
FIGS. 9 and 10 are examples of FFT magnitudes according to the present disclosure.
Figure 10:
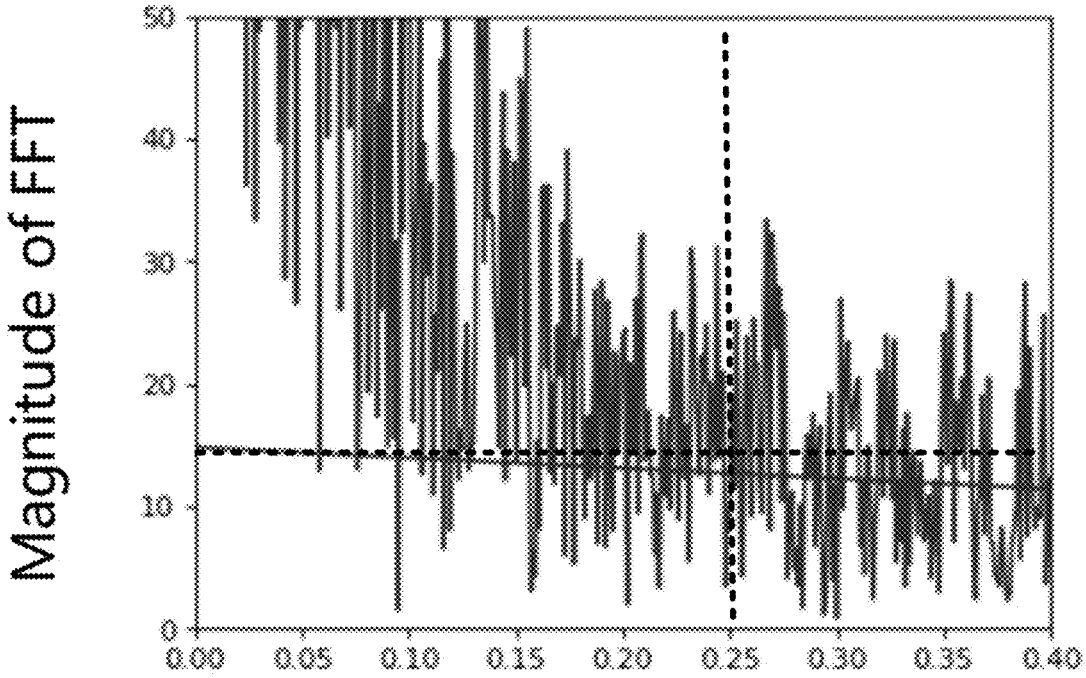
Figures 11A, 11B:
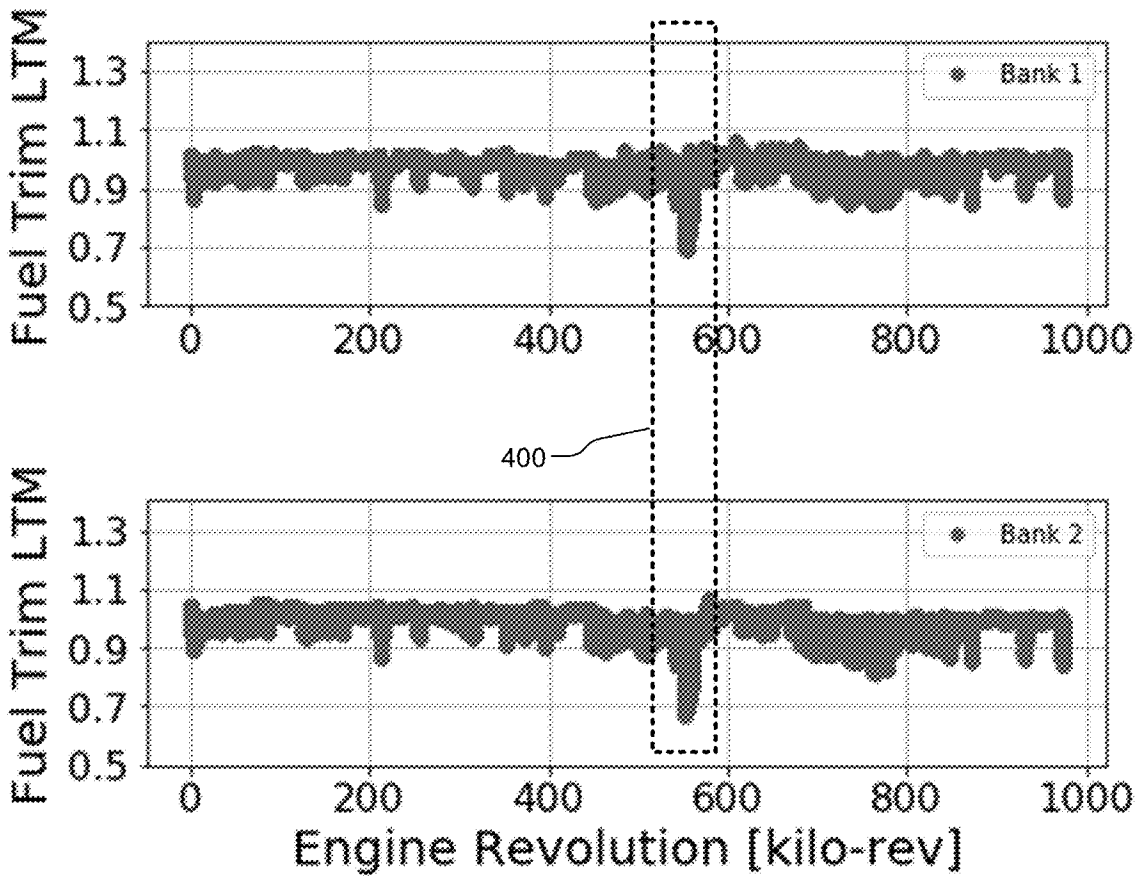
FIGS. 11A to 11D are examples of fuel trim LTM as a function of engine revolutions according to the present disclosure.
Figures 11C, 11D:
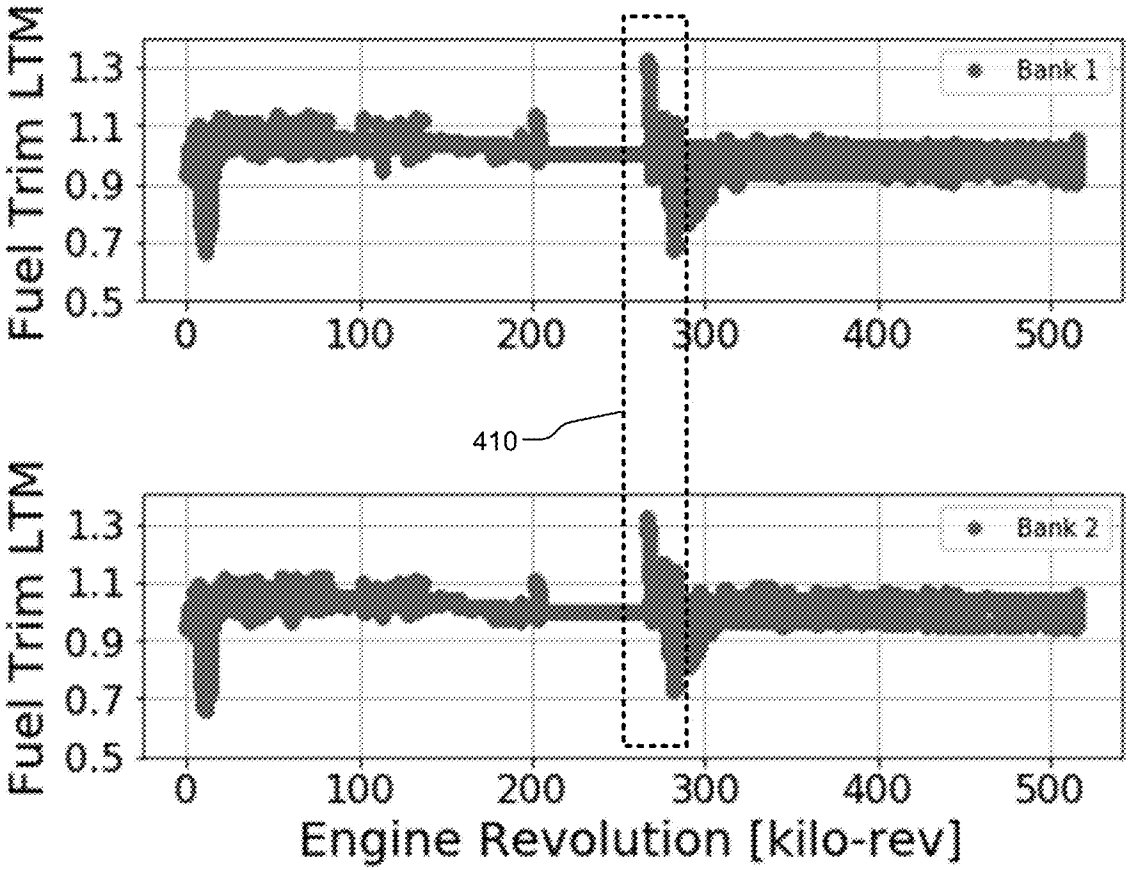

In FIGS. 9 and 10, examples of magnitude and frequency thresholds are shown for two moving window FFTs. The magnitude and frequency thresholds can be adjusted for a particular engine and/or vehicle.

Referring now to FIGS. 11A to 11D, sudden changes in long term fuel trim are shown as a function of engine revolutions. Relatively sudden changes in long term fuel trim are shown at 400 in FIGS. 11A and 11B and at 410 in FIGS. 11C and 11D.

Figure 12:
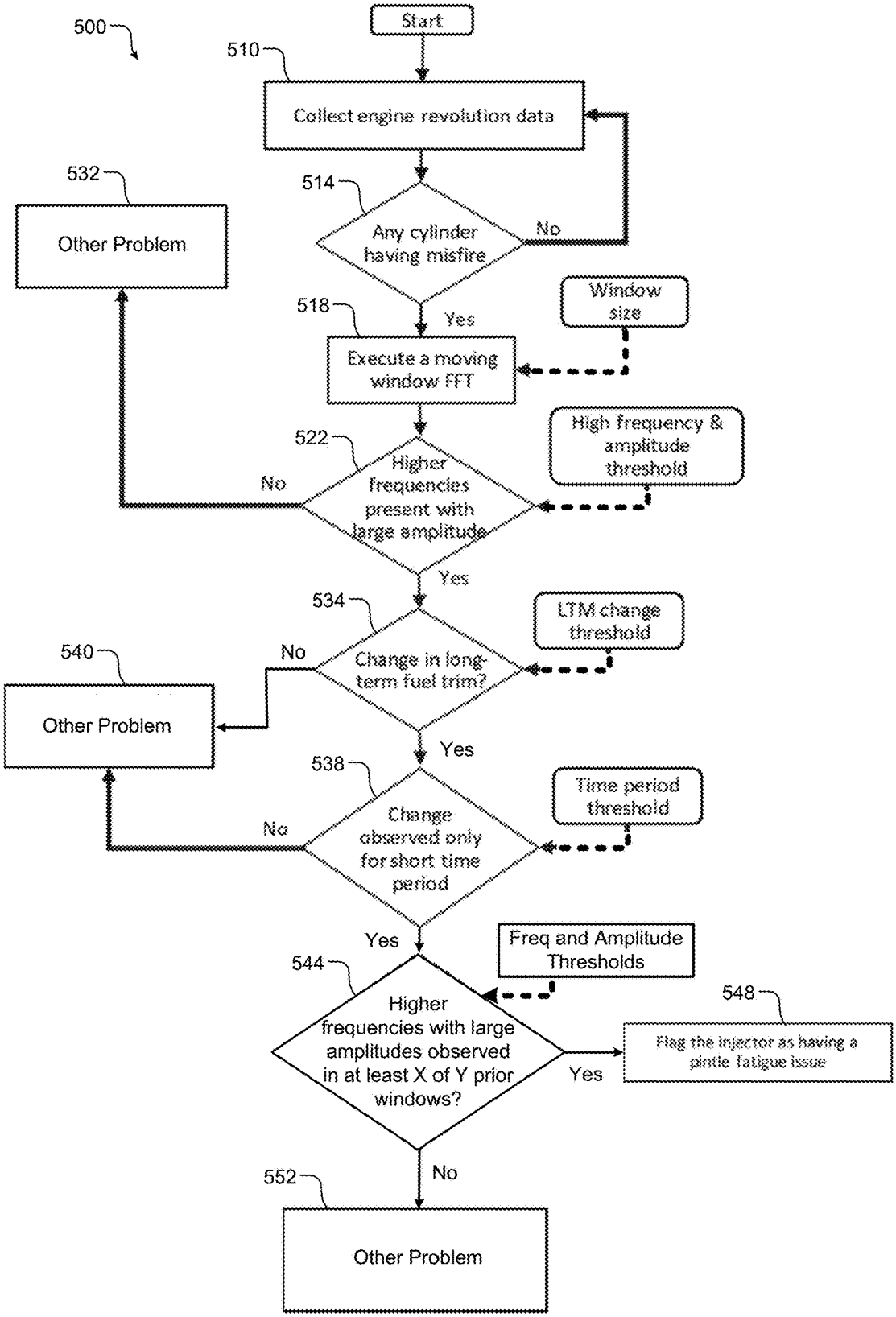
FIG. 12 is a flowchart of an example of a method for diagnosing pintle fatigue in a fuel injector according to the present disclosure.

Referring now to FIG. 12, a method 500 for diagnosing a fuel injector with a manufacturing issue is shown. At 510, engine revolution data is collected. At 514, the method determines whether any of the cylinders are misfiring. If 514 is false, the method returns to 510. If 514 is true, the method continues at 518 and executes a moving window fast Fourier transform (FFT). At 522, the method determines whether signal frequencies above a predetermined frequency are present with amplitudes greater than a predetermined amplitude. For example only, FIGS. 9 and 10 show examples of predetermined frequencies and/or magnitudes.

If 522 is false, the method continues at 532 (diagnosing problems other than fuel injector manufacturing issues). If 522 is true, the method continues at 534 and determines whether there is a change in the long term fuel trim. In some examples, if the slope and/or magnitude are sufficiently increasing and/or decreasing, then the long term fuel trim is considered to be changing.

For example, the long term fuel trim is considered to be changing if the slope of the long term fuel trim is greater than a predetermined positive slope of (and/or less than a predetermined negative slope) and/or if the magnitude of the long term fuel trim is greater than a first predetermined magnitude (and/or less than a second predetermined magnitude), although other thresholds can be used. For example, the predetermined positive slope can equal to 0.4, 0.5, 0.6, 0.7 and/or another value. For example, the predetermined negative slope can equal to −0.4, −0.5, −0.6, −0.7 and/or another value.

The first predetermined magnitude of the long term fuel trim can be set equal to 110% or 120% of a nominal long term fuel trim value. The second predetermined magnitude of the long term fuel trim can be set equal to 80% or 90% of a nominal long term fuel trim value.

If 534 is true, the method continues at 538 and determines whether the change has been observed for period that is less than a predetermined time period. If either 534 or 538 are false, then a problem other than manufacturing issues with the fuel injectors is diagnosed at 540.

If 538 is true, the method continues at 544 and determines whether higher frequencies with large amplitudes are observed in X of Y previous moving windows, where X and Y are integers and X<=Y. For example only, X=4 and Y=7, although other values can be used.

If 544 is true, the fuel injector is flagged as having a pintle fatigue issue at 548. If 544 is false, then a problem other than manufacturing issues with the fuel injectors is diagnosed.

Systems and methods described herein can be used to detect fuel injectors with pintle fatigue and/or a struck armature. By detecting these types of manufacturing issues earlier, the injectors can be replaced before causing additional damage and increased warranty costs.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to,"

"on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A diagnostic system for a fuel injector, comprising:

a plurality of sensors to sense vehicle data;

a controller including a fuel injector diagnostic module configured to receive the vehicle data during operation of a vehicle and to selectively identify a fuel injector with a stuck armature in response to:

at least one short term fuel trim value increasing; and a plurality of cylinder misfires occurring.

2. The diagnostic system of claim 1, wherein the fuel injector diagnostic module is further configured to identify the fuel injector with the stuck armature during an engine cold start.

3. The diagnostic system of claim 1, wherein the fuel injector diagnostic module is further configured to identify the fuel injector with the stuck armature in response to an engine cold start short term fuel trim value not being nominal.

4. The diagnostic system of claim 1, wherein the fuel injector diagnostic module is further configured to identify the fuel injector with the stuck armature in response to a fuel rail pressure being greater than a predetermine fuel rail pressure.

5. The diagnostic system of claim 1, wherein the fuel injector diagnostic module is further configured to identify a fuel injector with pintle fatigue based on a fast Fourier transform (FFT) of cylinder misfires as a function of a plurality of groups of consecutive engine revolutions in a window.

6. The diagnostic system of claim 5, wherein the fuel injector diagnostic module is further configured to identify the fuel injector with the pintle fatigue in response to the FFT having an amplitude greater than a predetermined amplitude at a frequency greater than a predetermined frequency in the window.

7. The diagnostic system of claim 5, wherein the fuel injector diagnostic module is further configured to identify the fuel injector with the pintle fatigue based on a fast Fourier transform (FFT) of cylinder misfires as a function of a plurality of groups of consecutive engine revolutions in a plurality of windows including the window.

8. The diagnostic system of claim 7, the fuel injector diagnostic module is further configured to identify the fuel injector with the pintle fatigue in response to greater than or equal to X of Y consecutive ones of the plurality of windows having an amplitude greater than a predetermined amplitude at a frequency greater than a predetermined frequency, where X and Y are integers and X is less than Y.

9. The diagnostic system of claim 1, wherein the fuel injector diagnostic module is further configured to identify the fuel injector with the stuck armature further in response to at least one long term fuel trim value changing more than a predetermined amount during a period less than a predetermined period.

10. A diagnostic system for a fuel injector, comprising:
a plurality of sensors to sense vehicle data; and
a fuel injector diagnostic module configured to:
receive the vehicle data during operation of a vehicle; and
selectively identify a fuel injector with pintle fatigue based on a fast Fourier transform (FFT) of cylinder misfires as a function of a plurality of groups of consecutive engine revolutions in a window.

11. The diagnostic system of claim 10, wherein the fuel injector diagnostic module is further configured to identify a fuel injector with a stuck armature based on at least one short term fuel trim value.

12. The diagnostic system of claim 11, wherein the fuel injector diagnostic module is further configured to identify the fuel injector with the stuck armature, during an engine cold start, in response to:
the at least one short term fuel trim value increasing; and
a plurality of cylinder misfires occurring.

13. The diagnostic system of claim 10, wherein the fuel injector diagnostic module is further configured to identify the fuel injector with the pintle fatigue in response to the FFT having an amplitude greater than a predetermined amplitude at a frequency greater than a predetermined frequency in a plurality of windows.

14. The diagnostic system of claim 13, the fuel injector diagnostic module is further configured to identify the fuel injector with the pintle fatigue in response to greater than or equal to X of Y consecutive ones of the plurality of windows having the amplitude greater than the predetermined amplitude at the frequency greater than the predetermined frequency, where X and Y are integers and X is less than Y.

15. The diagnostic system of claim 11, wherein the fuel injector diagnostic module is further configured to identify the fuel injector with the stuck armature further in response to at least one long term fuel trim value changing more than a predetermined amount during a period less than a predetermined period.

16. A diagnostic system for fuel injectors of a plurality of vehicles, comprising:
a server located remotely from the plurality of vehicles and configured to receive vehicle data generated by the plurality of vehicles during operation,
wherein the server includes:
a fuel injector diagnostic module configured to receive the vehicle data from the plurality of vehicles and to selectively identify at least one of:
one of the plurality of vehicles having a fuel injector with a stuck armature in response to:
a short term fuel trim value of the one of the plurality of vehicles increasing during an engine cold start; and
a plurality of cylinder misfires of the one of the plurality of vehicles occurring during the engine cold start.

17. The diagnostic system of claim 16, wherein the fuel injector diagnostic module is further configured to identify a fuel injector with pintle fatigue based on a fast Fourier transform (FFT) of cylinder misfires for the one of the plurality of vehicles as a function of a plurality of groups of consecutive engine revolutions of the one of the plurality of vehicles in one or more windows.

* * * * *